US005620282A

United States Patent [19]

Stinton

[11] Patent Number: 5,620,282

[45] Date of Patent: Apr. 15, 1997

[54] BUOYANCY COMPENSATOR ASSEMBLY

[75] Inventor: Robert T. Stinton, Lakeside, Calif.

[73] Assignee: Diving Unlimited International, San Diego, Calif.

[21] Appl. No.: 353,628

[22] Filed: Dec. 12, 1994

[51] Int. Cl.[6] ..... B65C 11/02

[52] U.S. Cl. ..... 405/186; 441/106; 441/96

[58] Field of Search ..... 405/185, 186; 441/90, 92, 106, 114, 96

[56] References Cited

U.S. PATENT DOCUMENTS

| | | | |
|---|---|---|---|
| 3,536,071 | 10/1970 | Ferrando | 128/142.5 |
| 3,898,705 | 8/1975 | Schuler | 9/313 |
| 3,964,266 | 6/1976 | Bartlett | 61/70 |
| 4,016,616 | 4/1977 | Walters | 9/339 |
| 4,137,585 | 2/1979 | Wright, III | 9/314 |
| 4,752,263 | 6/1988 | Pritchard et al. | 405/186 X |
| 4,778,307 | 10/1988 | Faulconer | 405/186 |
| 4,779,554 | 10/1988 | Courtney | 405/186 X |
| 4,913,589 | 4/1990 | Faulconer et al. | 405/186 |
| 5,022,790 | 6/1991 | Stevenson | 405/186 |
| 5,106,236 | 4/1992 | Hancock et al. | 405/186 |
| 5,249,890 | 10/1993 | Bergstrom | 405/186 |
| 5,256,094 | 10/1993 | Canna | 441/96 |
| 5,346,419 | 9/1994 | Kaiser | 441/96 |
| 5,378,084 | 1/1995 | Walters et al. | 405/186 |

FOREIGN PATENT DOCUMENTS

| | | | |
|---|---|---|---|
| 8339775 | 8/1975 | Australia . | |
| 0318157 | 5/1989 | European Pat. Off. . | |
| 3717156 | 12/1988 | Germany | 405/186 |
| 404046889 | 2/1992 | Japan | 405/186 |

*Primary Examiner*—Tamara L. Graysay
*Assistant Examiner*—Frederick Lagman
*Attorney, Agent, or Firm*—Brown, Martin, Haller & McClain

[57] ABSTRACT

A buoyancy compensator assembly includes an inflatable bladder for supporting on a diver's back. Inflation of the bladder and venting of the bladder are controlled from a control unit carried at the front of the diver. The bladder has a passageway extending under a portion of the bladder for guiding hoses from the outside of the bladder at the rear of the diver towards the control unit at the front of the diver. A guide sleeve extends from the bladder over the diver's shoulder for holding hoses close to the diver's body.

20 Claims, 3 Drawing Sheets

BUOYANCY COMPENSATOR ASSEMBLY

BACKGROUND OF THE INVENTION

The present invention relates generally to a buoyancy compensator assembly in which an inflatable bladder is used to control a diver's buoyancy.

A buoyancy compensator or control device (BCD) is currently used by scuba divers to regulate their buoyancy during the course of a dive. The need for this regulation results from changes in the diver's water weight and water displacement during the course of a dive. For example, the diver's weight in water/displacement will change as a result of the compression of gas in the wetsuit or dry suit they are wearing with increased depth. The average diver experiences up to five pounds change in water weight as a result of air consumed from the tank or scuba cylinder. There are also times when diver's may want to change their buoyancy as a result of environmental conditions. For example, a diver in current may want to dive heavy to facilitate staying in one place on the bottom. On the surface, a diver may want additional positive buoyancy for better surface flotation.

Buoyancy compensators typically consist of an inflatable bladder carried or worn by the diver and a diver actuated control device for controlling addition of gas to the bladder or venting of gas from the bladder to control buoyancy. In the most widely used buoyancy compensators, the bladder is mounted on the diver's back. The air supply tank is also worn on the diver's back, while the control device for controlling supply from the tank to the bladder, and the diver's breathing mouthpiece, are at the front of the diver. Thus, various air hoses must be routed from the tank to the front of the diver and from the front of the diver to the buoyancy compensator. Currently, divers typically have multiple hoses running from the first stage regulator mounted on the air or scuba cylinder. These hoses typically are routed out and around the inflatable bladder of the BCD and around the diver's body. As the bladder inflates, the hose route becomes longer. Thus, the hoses must be made longer than necessary. Additionally, the presence of multiple hoses running around the outside of the diver's body and inflatable bladder increases the risk of entanglement. Entanglement of air hoses is one of the most common causes of diving accidents.

SUMMARY OF THE INVENTION

It is an object of the present invention to provide a new and improved buoyancy compensator assembly which reduces the risk of hose entanglement.

According to the present invention, a buoyancy compensator assembly is provided which comprises an inflatable bladder adapted for wearing at least partially on a diver's back, the bladder having at least one passageway extending beneath the bladder for routing air hoses from an outer wall to an inner wall of the bladder. Preferably, at least two air hoses extend through the passageway under the bladder and over the diver's shoulder for connection to a control valve assembly at the diver's front for controlling bladder inflation. One of the hoses extends from an outlet of the control valve assembly through the passageway to an inlet port of the bladder, while the other hose extends from a low pressure air supply such as a diving tank to an inlet of the control valve assembly.

Additional hoses may extend through the passageway, and the passageway may be adjustable in size to accommodate other items routed from the outer to the inner side of the bladder. Preferably, a control cable for controlling a bladder vent valve also extends through the passageway for connection to a suitable actuator for operating by the diver as needed.

In a preferred embodiment of the invention, the bladder is permanently or releasably mounted on a suitable harness including shoulder straps, and a sleeve is mounted on one shoulder strap for guiding the hoses and control cable from the bladder passageway to the control valve assembly and vent valve actuator. The control valve assembly is preferably mounted on a control pad on the harness adjacent the sleeve, and the vent valve actuator is preferably also mounted on the control pad.

The control valve assembly preferably comprises an air distribution block having an inlet for connection to an air supply hose, an outlet for connection to the bladder supply hose, a valve for controlling communication between the inlet and the outlet, and a manually operable valve control member for controlling opening and closing of the valve. The block may have at least one additional low pressure air outlet for providing air flow to other items of equipment, for example to a hose connected to a dry suit inlet valve. This reduces the number of hoses which must run from the rear to the front of the diver.

With this arrangement, the hoses and the or each control cable may be routed close to the body, and beneath the inflatable bladder so that their path does not increase with bladder inflation. This reduces drag and also reduces the risk of entanglement. The control valve assembly is in a fixed position on the harness, instead of hanging freely over a diver's shoulder as -in the past, so that the position of the buoyancy compensator controls does not change during the course of a dive and the diver can easily find the bladder inflation and exhaust controls as needed.

BRIEF DESCRIPTION OF THE DRAWINGS

The present invention will be better understood from the following detailed description of some preferred embodiments of the invention, taken in conjunction with the accompanying drawings, in which like reference numerals refer to like parts, and in which.

DESCRIPTION OF THE PREFERRED EMBODIMENT

Figure 1:
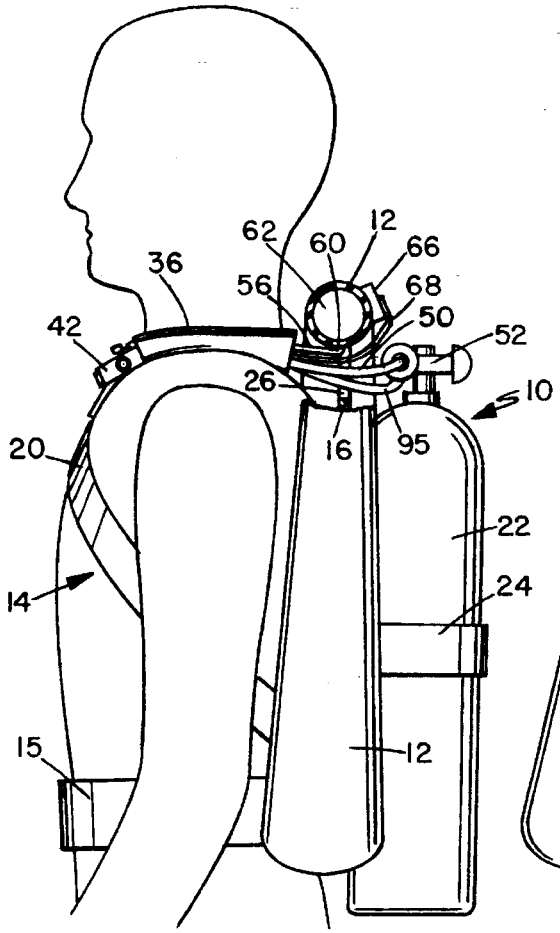
FIG. 1 is a side view of the buoyancy compensator assembly according to a preferred embodiment of the invention, as worn by a diver.
Figure 2:
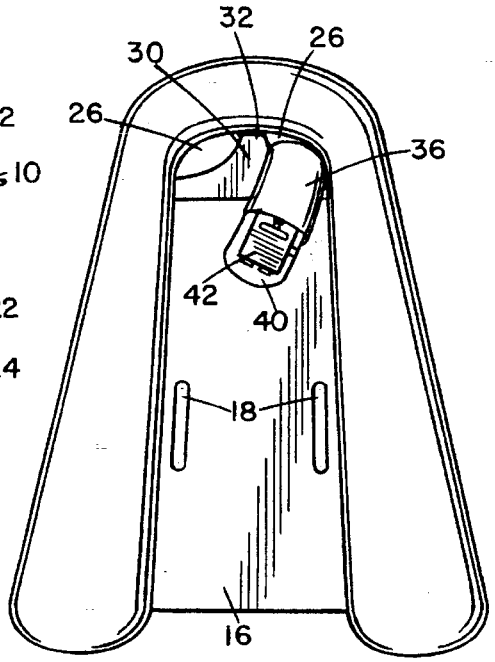
FIG. 2 is a front view of the buoyancy bladder and control unit.
Figure 3:
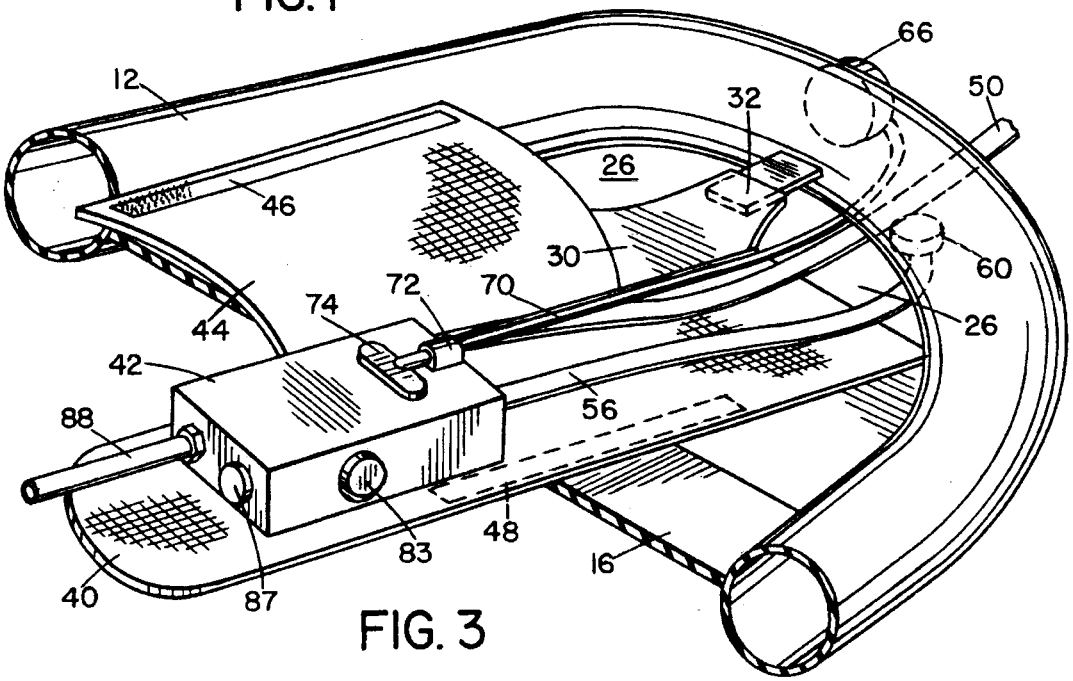
FIG. 3 is a perspective view of the upper portion of the bladder and the control unit and hoses.
Figure 4:
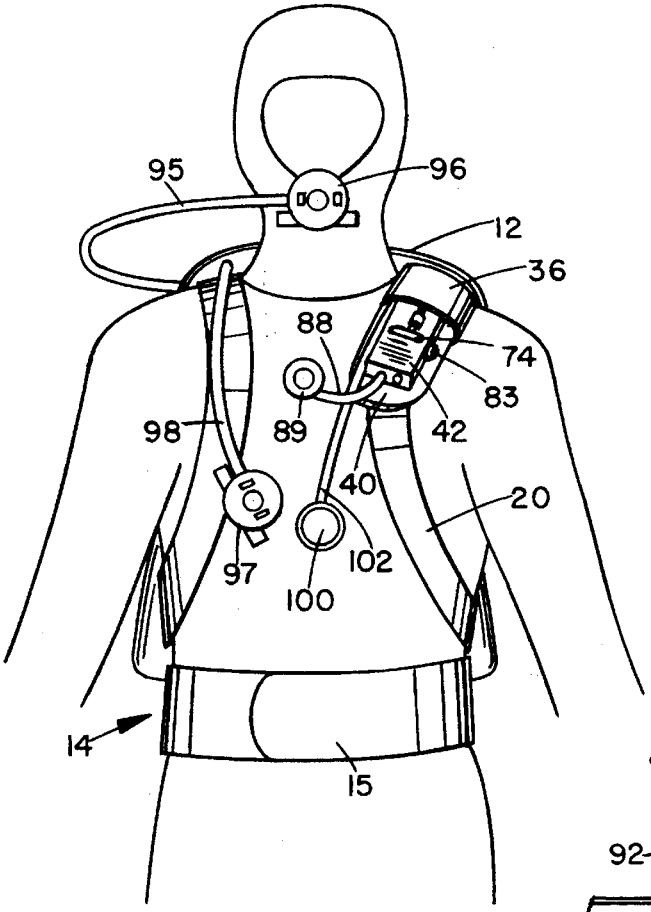
FIG. 4 is a front view of the complete assembly on a diver.

A buoyancy compensator assembly 10 according to a first embodiment of the present invention is illustrated in FIGS. 1–7. FIGS. 1 and 4 illustrate the assembly as worn by a diver. As best illustrated in FIGS. 1–4, the assembly 10 basically comprises an inflatable bladder 12 of a generally inverted U-shape configuration, and a harness 14 for supporting the bladder on a diver's back. Harness 14 includes shoulder straps 20 including shoulder portions for extending over a diver's shoulders and waist strap 15. The bladder includes a central support web or panel 16 with holes or slots 18 through which the harness straps 20 are extended for supporting the bladder from a diver's shoulders. It will be understood that different sizes and shapes of bladder may be used in alternative embodiments depending on the type of diving and the buoyancy control range and trim requirements, for example an oval-shaped bladder or other alternatives. A scuba or air tank 22 may be suitably secured to panel 16 via retaining strap or band 24 in a conventional manner. Any suitable support device may be used for supporting the assembly 10 on the wearer's back, such as the harness 14 as illustrated or a jacket or the like. The bladder assembly may be permanently secured on the harness or jacket in alternative arrangements.

One or more ports or passageways 26 extend through bladder panel 16 beneath a central portion 28 of the U-shaped bladder to allow various hoses to be routed beneath the bladder. Preferably, two such ports are provided, as illustrated in FIGS. 2 and 3. A section 30 of the panel 16 between the ports may be releasably secured to the remainder of the bladder via a suitable fastener 32 such as Velcro®, as illustrated in FIG. 3. Section 30 can be selectively released to make the two smaller ports into a single, larger port or passageway.

Figure 5:
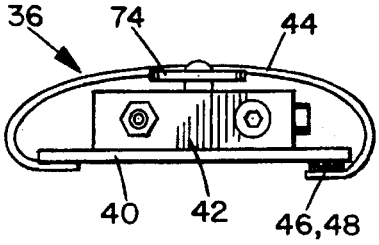
FIG. 5 is an end view of the control unit and guide sleeve.

A guide sleeve 36 extends from one of the ports up over one of the harness shoulder straps 20 to the front of the harness, and a control pad or tongue 40 projects forwardly from the front end of sleeve 36. An air distribution or inflation control unit 42 is mounted on the control pad. Unit 42 may be permanently secured to the control pad via adhesive, stitching or the like, or may be releasably mounted via suitable releasable fasteners such as Velcro®, snap fasteners or the like. Preferably, the upper wall of sleeve 36 comprises a releasable closure flap 44 which has a suitable fastener such as snaps or a Velcro® strip 46 for securing to a mating Velcro® strip 48 on an opposite edge of the lower wall of the sleeve to form a tubular enclosure, as best illustrated in FIGS. 3 and 5. The flap may be released and the sleeve opened for easier routing of hoses and other items to be guided via the sleeve, and the flap can then be re-closed to retain the various hoses and the like.

The guide sleeve 36 and control pad or extension 40 may be formed as an integral extension from the top of panel 16 adjacent opening or port 26, as illustrated in FIG. 3. Preferably, the sleeve and control pad are also secured by stitching or other permanent or releasable fasteners to the underlying shoulder strap 20 of the harness, so that they remain in a fixed position at the front of the diver's shoulder during all diving conditions and orientations.

A number of hoses are routed through opening or port 26 and sleeve 36 to the control unit 42, as illustrated in FIGS. 1 and 3. A first, air supply hose 50 is connected at one end to a first stage regulator 52 on scuba or air tank 22, and is routed through bladder port 26 and sleeve 36 for connection at its opposite end to an air inlet 54 of the control unit 42. A second, bladder supply hose 56 has a first end connected to an air outlet 58 of the control unit 42, and extends through sleeve 36 and port 26 for connection at its opposite end to a supply inlet 60 of the bladder 12. The bladder has an internal, air tight chamber 62 which can be filled with air via inlet 60 to inflate the bladder. Inlet 60 is preferably located at the upper portion of the bladder adjacent the diver's shoulder. A vent outlet 64 of the bladder is also located adjacent the diver's shoulder, and an over-pressure relief valve or dump valve 66 is mounted over vent outlet 64. A cable 68 for activating the relief valve 66 extends from valve 66 through tubular cable housing 70 which extends from the valve 66, through port 26 and sleeve 36 and through an eyelet or retainer bracket 72 on unit 42. The free end of cable 68 is secured to an actuation handle 74 on the other side of eyelet 72, so that the valve 66 can be opened by pulling down on handle 74.

Figure 6:
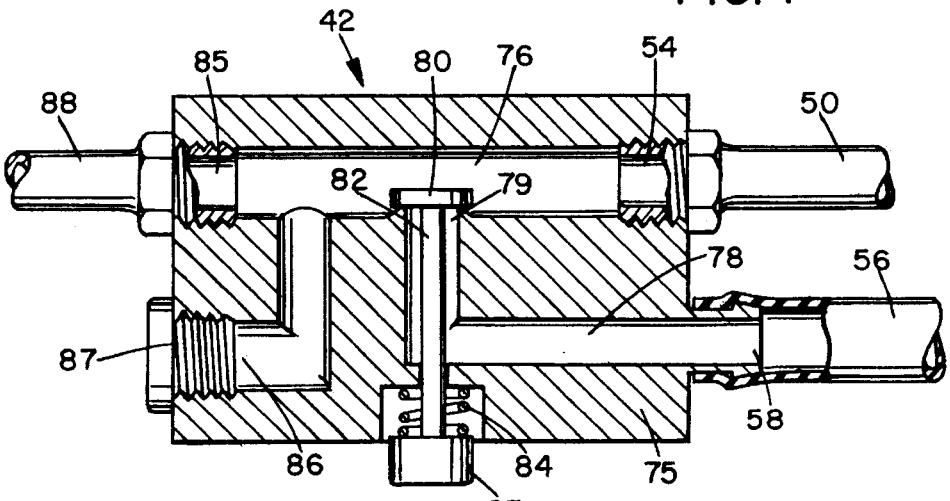
FIG. 6 is a longitudinal sectional view through the control unit.

The air distribution unit 42 is illustrated in more detail in FIG. 6. As illustrated in FIG. 6, the unit basically comprises an outer housing 75 with a first internal passageway 76 connected to air inlet 54, a second internal passageway 78 connected to air outlet 58, and an orifice 79 connecting the first passageway 76 to the second passageway 78. A valve 80 controls the opening of orifice 79 to supply air to the bladder, and valve stem 82 projects out of the housing for connection to the inflation valve actuation button 83. Spring 84 biases the valve into the closed position. The diver thus presses button 83 inwardly to open the valve and allow air to flow into the bladder, and releases the bladder once the desired buoyancy is achieved. The housing 75 preferably also has two auxiliary low pressure air ports 85, 86 for selective connection to other devices requiring a low pressure air supply. If not needed, the ports may be closed via a cap 87, which is shown closing and sealing port 86 in FIG. 6. The other port 85 is connected to one end of a dry suit supply hose 88 which is connected to a dry suit supply valve 89 at its opposite end, as illustrated in FIG. 4. Both ports 85 and 86 communicate with air inlet 54 as illustrated. By providing additional low pressure ports on the air distribution unit 42, the number of hoses which have to be routed around the diver's body from the supply tank 22 is reduced.

Figure 7:
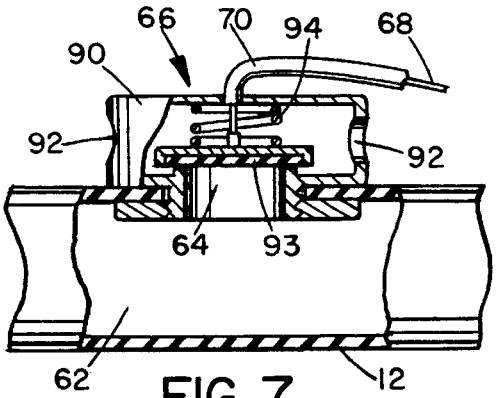
FIG. 7 is a side view, partially cut away, of the dump valve.

The vent valve 66 is illustrated in more detail in FIG. 7. Valve 66 basically comprises a housing 90 which is secured over the bladder vent outlet 64 and has a plurality of vents or outlet openings 92. A valve member 93 in the housing is biassed against vent outlet 64 by spring 94 so as to normally seal the bladder vent outlet 64. Actuator cable 68 is secured to valve member 93 and projects out of the housing and through the cable housing 70. Thus, when the diver wishes to vent some air from the bladder 12 in order to reduce buoyancy, he or she simply pulls down on handle 74, which is conveniently accessible on the control pad. This pulls on cable 68 and in turn pulls up the vent valve member 93 to allow air to vent out of the bladder chamber 62 via vents 92. The diver releases the handle 74 when the desired buoyancy is achieved, so that the spring 94 biases valve member 93 back into the closed position.

In addition to the first air supply hose 50, another air supply hose 95 extends from regulator 52 on the air tank to a primary demand regulator or mouthpiece 96 through which the diver breathes. The primary demand hose 95 may be routed through the other port or opening 26 in the bladder and up over the diver's opposite shoulder to sleeve 36, as illustrated in FIG. 4. Diving equipment normally also includes a second or alternate emergency demand regulator or mouthpiece 97 which is connected via an additional hose 98 to the air tank. This is preferably also routed through one of the ports 26 and up over the diver's opposite shoulder to the BC control pad.

A conventional cylinder pressure gauge 100 located at the front of the diver is connected via hose 102 to the cylinder or tank behind the diver's back to provide the diver with an indication of the air remaining in the tank. Hose 102 is preferably also routed through sleeve 36 and opening 26 in the bladder panel so that it is held out of the way and is unlikely to cause an entanglement hazard. The provision of releasable closure flap 44 on the sleeve 36 allows the sleeve to be opened to allow larger items such as regulators and pressure gauges to be passed through the sleeve to the front of the diver, before re-closing the sleeve over the regulator and pressure gauge hoses.

Figure 9:
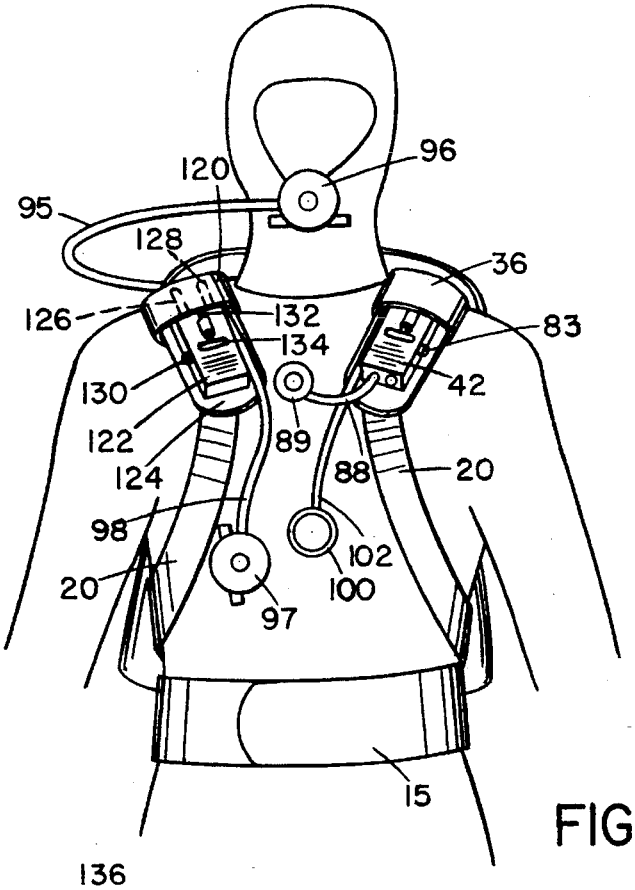
FIG. 9 is a front view of the dual bladder assembly on a diver.
Figure 8:
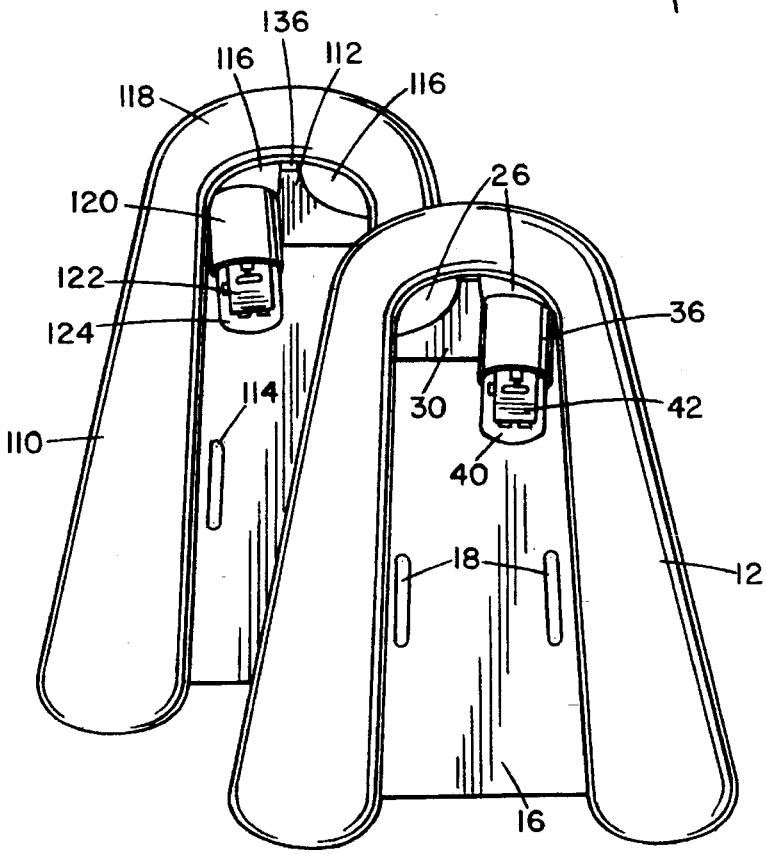
FIG. 8 is a front view of a dual bladder configuration.

FIGS. 8 and 9 illustrate a modified embodiment of the invention in which a reserve buoyancy compensator assembly is used in addition to the primary buoyancy compensator assembly. Reserve or redundant buoyancy control systems are commonly used in more demanding diving applications. This embodiment of the invention is similar to that of FIGS. 1–7 apart from the provision of a reserve buoyancy control assembly, and like reference numerals have been used for like parts as appropriate. As in the first embodiment, a primary buoyancy control bladder 12 having a support panel 16 is mounted on the diver's back via harness 14 extending through openings 18 in panel 16, and various hoses are routed through opening 26 in the back panel beneath an upper portion of the bladder and through a sleeve 36 over one of the diver's shoulders for connection to a control unit 42 at the front of the diver. Additionally, a secondary or reserve buoyancy control bladder 110 which is of equivalent shape and dimensions to the first bladder is mounted beneath primary bladder 12. Bladder 110 also has a support panel 112 and harness receiving openings 114. The harness will extend through openings 114 and aligned openings 18 in the first panel to support both bladders on the diver's back. The arrangement may be reversed if desired so that the primary bladder is mounted behind the secondary bladder.

The secondary bladder 110 also has openings or ports 116 for routing hoses and the like beneath an upper portion 118 of the bladder. A guide sleeve 120 extends from the opposite one of the ports 116 to sleeve 36, and through the aligned port 26 in the first panel. Sleeve 120 can then extend over the opposite shoulder to the first guide sleeve 36, as best illustrated in FIG. 9. A control unit 122 similar to control unit 42 of the primary buoyancy control system is mounted on control pad 124 at the free end of sleeve 120. The sleeve and control pad may be releasably or permanently secured to the shoulder strap 20. The structure of the secondary buoyancy control unit is identical to that of unit 42 of the first assembly. Secondary air hoses 126, 128 extend from the tank through opening 116 and sleeve 120 to the control unit inlet, and from the control unit outlet through sleeve 120 and opening 116 to the air inlet of bladder 110. Control button 130 on the control unit controls the opening of a valve to supply air to the secondary bladder, in the same way as button 83 controls supply of air to the primary bladder. A vent valve actuator cable 132 extends from a vent valve on the secondary bladder through opening 116 and sleeve 120 to the vent valve handle 134 on control unit 122. Secondary air supply hose 98 may also extend through opening 116 and sleeve 120, with the releasable closure flap of sleeve 120, which is identical to flap 44 of sleeve 42, allowing the secondary or emergency demand regulator 97 to be passed to the front of the diver before closing the sleeve 120 around the various hoses.

The pair of ports 26 in the primary bladder support panel can be made into one larger port by releasing fastener 32. Similarly, the two ports 116 in the secondary bladder panel 112 are also separated by a releasable portion of the panel which is removably secured to the bladder via a similar fastener 136. Each of the sleeves is also releasably closed by a releasable closure flap. Thus, the ports 26 and 116 can be enlarged as necessary to allow passage of larger items to which cables or hoses are secured, such as regulators, pressure gauges and the like, and the respective sleeve closure flaps can be released at the same time so that the larger items may be passed to the front of the diver's harness. The fasteners 32 and 136 may then be re-secured and the sleeve closure flaps may be re-closed around the various cables and hoses, retaining them close to the diver's body.

Thus, for applications where a reserve or second buoyancy control device is needed, the reserve bladder is simply mounted on the harness behind the primary bladder, and a guide sleeve extends from the reserve bladder over the opposite shoulder to the primary buoyancy compensator guide sleeve. In this way, various hoses can be routed over the opposite shoulders of the diver and held close to the diver's body.

In each of the above embodiments, the air distribution block with auxiliary outlet ports allows air to be routed to other items of equipment requiring low pressure air, such as a dry suit inlet valve, avoiding the need for additional hoses extending from the back of the diver to the front. The number and length of hoses is therefore reduced. The air distribution block is secured at a fixed position on the front of the diver's harness, rather than hanging loosely as in the past, so that the diver can easily locate it at all times, whatever the diving orientation or surrounding visibility.

The use of ports under the bladder for routing cables and hoses from the back to the front of the diver, along with one or more guide sleeves for holding the hoses and cables close to the body, reduces the risk of entanglement accidents. In previous arrangements with numerous hoses extending freely from behind the diver to the front of the diver, the hoses would float around to some extent and change position with the diver's movement, producing a substantial entanglement risk. Additionally, the numerous hoses produce a bulky appearance and increase drag. In such systems, the diver also had to don the tank unit and then rout various hoses from the back to the front. Due to the diver's limited vision, hoses sometimes became mis-routed or entangled in other diving gear.

With the arrangement of this invention, hoses are routed close to the diver's body rather than floating freely, providing better streamlining and reduced drag and also significantly reducing the risk of entanglement. The position of the buoyancy compensator controls does not change during the course of a dive, making the controls easier to find when needed, which is particularly important in an emergency situation. The routing of the hoses close to the body and beneath a portion of the bladder, rather than over the outside of the bladder as in the past, reduces the length of hose needed. When the hoses were routed outside the bladder, they had to be made long enough to span the fully expanded bladder, increasing the risk of entanglement. With this arrangement, hose length can be minimized. Additional reduction in overall hose length is provided by means of the additional air outlet ports on the air distribution unit, reducing the number of hoses which have to extend from the rear to the front of the diver's body.

Although in the illustrated embodiments the hoses and cables are routed below a portion of the bladder or bladders, in some bladder configurations a tunnel or passageway may be provided over the top of the bladder, in cases where there will be no dimensional change at that position on inflation of the bladder.

Although some preferred embodiments of the invention have been described above by way of example only, it will be understood by those skilled in the field that modifications may be made to the disclosed embodiments without departing from the scope of the invention, which is defined by the appended claims.

I claim:

1. A buoyancy compensator assembly, comprising:

an inflatable bladder having an internal chamber for filling with gas to control buoyancy of a diver, an inlet port for supply of gas to the bladder, and an outlet port for exhaust of gas from the bladder, the bladder being adapted for mounting at least partially on a diver's back and having an outer face and an inner face;

at least one passageway extending beneath the bladder from the outer face to the inner face of the bladder;

a bladder inflation control valve for controlling supply of air to the bladder inlet port; and at least two hoses extending through the passageway and over a diver's shoulder when the bladder is mounted on a diver's back, one of the hoses having a first end connected to said bladder inlet port and a second end connected to said bladder inflation control valve, and the other hose having a first end connected to the bladder inflation control valve and a second end for connection to a low pressure gas supply.

2. The assembly as claimed in claim 1, wherein the bladder at least partially surrounds a central open area and has a support panel extending across the open area.

3. The assembly as claimed in claim 2, wherein the bladder has an upper connecting portion and a pair of side portions, and the passageway comprises an opening in the support panel adjacent the upper connecting portion.

4. The assembly as claimed in claim 1, including a tubular sleeve having a first end adjacent said passageway at the inner face of said bladder and a second end, the sleeve comprising means for extending from the bladder over a diver's shoulder to guide said hoses over the diver's shoulder.

5. The assembly as claimed in claim 4, including a control pad adjacent the second end of said sleeve, said inflation control valve comprising an air distribution device mounted on said control pad, the distribution device having an air inlet, an air outlet, a valve for controlling connection of the air inlet to the air outlet, and a manually operable control member for controlling the valve.

6. The assembly as claimed in claim 5, including a vent valve mounted on the outlet port of the bladder, the vent valve having a valve member biased into a closed position, and an actuator cable having a first end secured to the valve member, the cable extending through said passageway and sleeve and having a second end projecting out of the second end of the sleeve, and an actuator handle secured to the second end of the cable for pulling by a diver to open the vent valve.

7. The assembly as claimed in claim 5, wherein the sleeve has a releasable closure flap for releasably closing the sleeve to retain hoses in the sleeve.

8. The assembly as claimed in claim 7, wherein the sleeve comprises a panel secured to said bladder and projecting in a first direction away from an upper end of said bladder, the panel having opposite side edges and said flap projects transversely from one side edge of said panel, the flap having an outer end and a first fastener device at the outer end of the flap, and the opposite side edge of the panel having a second fastener device for releasable mating engagement with the first fastener device to secure the flap over the panel to form a tubular sleeve.

9. The assembly as claimed in claim 1, including a support harness for donning by a diver to support said bladder on a diver's back, said inflation control valve being secured to a front portion of said harness.

10. The assembly as claimed in claim 1, wherein the bladder has two passageways for selectively routing items from the outer to the inner face of the bladder.

11. The assembly as claimed in claim 10, wherein the passageways are adjustable in size.

12. The assembly as claimed in claim 11, including a releasable flap separating the passageways and a fastener for releasably securing the flap between the passageways, the fastener being releasable to release the flap and convert the two passageways into a single, larger passageway.

13. The assembly as claimed in claim 1, wherein the inflation control valve comprises an air distribution housing having a first air inlet, a first internal passageway connected to said first air inlet, a first air outlet, a second internal passageway connected to said first air outlet, an orifice connecting said first and second internal passageways, a valve movable between a position closing said orifice and a position in which said orifice is open to allow communication between said passageways, and at least one auxiliary air outlet connected to said first passageway for selective connection to other devices requiring air input.

14. A buoyancy compensator assembly, comprising:

an inflatable bladder having an internal chamber for filling with gas to control buoyancy of a diver, an inlet port for supply of gas to the bladder, and an outlet port for exhaust of gas from the bladder;

a harness for mounting the bladder at least partially on a diver's back, the harness including shoulder portions for extending over the diver's shoulders, the bladder having an outer wall for facing away from the diver when mounted and an opposite, inner wall;

at least one passageway extending from the outer wall to the inner wall of the bladder for guiding hoses from one side of the bladder to the other; and at least one elongate guide sleeve extending from the inner wall of the bladder over one shoulder portion of the harness to a location at the front of a diver's shoulder, the guide sleeve comprising means for guiding hoses from the passageway over a diver's shoulder to a location at the front of a diver.

15. The assembly as claimed in claim 14, wherein the guide sleeve comprises a tubular member having a first end adjacent the bladder and a second end spaced from the first end by a predetermined distance at least equal to the width across a shoulder portion of the harness, a control pad formed integrally with the tubular member and projecting from the second end of the guide sleeve, and an air distribution control unit mounted on said control pad for controlling supply of air to said bladder, the guide sleeve and control pad being permanently secured to said harness.

16. The assembly as claimed in claim 14, including two passageways extending from the outer wall to the inner wall of the bladder, and two elongate guide sleeves, one guide sleeve comprising means for guiding hoses from one of the passageways over one shoulder of a diver and the other guide sleeve comprising means for guiding hoses from the other passageway over the opposite shoulder of the diver.

17. A buoyancy compensator assembly, comprising:

an inflatable bladder having an internal chamber for filling with gas to control buoyancy of a diver, an inlet port for supply of gas to the bladder, and an outlet port for exhaust of gas from the bladder;

a harness designed to fit over the shoulders of a diver, the harness being secured to the bladder to support the bladder adjacent the diver's body;

a control valve unit for controlling supply of gas to the bladder, the control valve unit having a base permanently secured to the harness at a position to the front of a diver when the harness is worn;

the control valve unit having an air inlet, an air outlet, internal passageways connecting the air inlet to the air outlet, a valve in the passageways movable between a closed position cutting off the connection between the inlet and outlet and an open position in which the inlet is connected to the outlet, and a manually operable actuator for selectively moving the valve into the open position;

a first air hose having a first end connected to the air inlet of the valve unit and a second end for connection to a supply of pressurized air; and a second air hose having a first end connected to the air outlet of the valve unit and a second end connected to the bladder inlet port.

18. The assembly as claimed in claim 17, wherein the control valve unit has at least one additional air outlet connected to the air inlet for connection to other devices requiring a low pressure air supply.

19. The assembly as claimed in claim 18, wherein the control valve unit has two additional air outlets.

20. The assembly as claimed in claim 17, including at least one elongate guide passageway for guiding said air hoses from the bladder and air supply to said control valve unit.

* * * * *